US006161902A

United States Patent [19]

Lieberman

[11] Patent Number: 6,161,902

[45] Date of Patent: Dec. 19, 2000

[54] STABILIZED INFLATABLE CHAIR

[75] Inventor: Marvin S. Lieberman, New York, N.Y.

[73] Assignee: Alvimar Manfacturing Co., Inc., Long Island City, N.Y.

[21] Appl. No.: 09/111,654

[22] Filed: Jul. 8, 1998

[51] Int. Cl.[7] ..... A47C 4/54

[52] U.S. Cl. ..... 297/452.41; 297/DIG. 3

[58] Field of Search ..... 297/452.41, DIG. 3; 5/654, 681, 710

[56] References Cited

U.S. PATENT DOCUMENTS

| | | | |
|---|---|---|---|
| 3,712,674 | 1/1973 | Ando | 297/452.41 |
| 3,740,095 | 6/1973 | Nail | 297/452.41 |
| 5,005,902 | 4/1991 | Farnworth | 297/452.41 X |
| 5,516,188 | 5/1996 | Bruhnke et al. | 297/452.41 X |

FOREIGN PATENT DOCUMENTS

| | | | |
|---|---|---|---|
| 806896 | 6/1951 | Germany | 297/452.41 |
| 607942 | 9/1960 | Italy | 297/452.41 |

*Primary Examiner*—Peter R. Brown
*Attorney, Agent, or Firm*—Steinberg & Raskin, P.C.

[57] ABSTRACT

An inflatable chair having a seat with front, rear, top, bottom and opposite side portions, a back at the rear of the seat, a pair of armrests at the sides of the seat, the seat, back and armrests defining inflatable first air chambers, a first valve for inflating the first air chambers, the bottom having front, rear and opposite side parts the chair further including generally tubular inflatable second air chambers at the front and rear and side parts respectively of the seat, and a second valve for inflating the second air chambers independently of the first air chambers for providing a stabilizing support to resist tipping of said chair.

13 Claims, 6 Drawing Sheets

STABILIZED INFLATABLE CHAIR

RELATED INVENTIONS

This invention is related to disclosures in the following U.S. patents:

| Pat. No. | Inventor | Date |
|---|---|---|
| D395,556,169 | Marvin S. Lieberman | June 30, 1998 |
| Ser. No.: 29/081,709 | Marvin L. Lieberman | |
| D378,169 | Shan Lin Yu | February 1997 |

BACKGROUND OF THE INVENTION

1. Field of the Invention

This invention is in the field of inflatable chairs and sofas, and particularly inflatable chairs and sofas made of thin, flexible plastic sheet with seat, back and arm parts that may constitute a single inflatable air chamber or a plurality of independently inflatable air chambers.

2. Prior Art

Inflatable chairs and sofas in the prior art are popular for numerous reasons, including providing large attractive seating furniture at a very small cost, providing furniture that can be readily inflated and immediately used or readily deflated and stored in a very small space, providing furniture that can receive unlimited graphic design on its surface, and providing furniture that can be easily cleaned with soap and water.

This furniture is somewhat balloon-like with stiffness and bounciness that depends partly on the amount and pressure of inflation and partly on the configuration. While the overall chair shape is established by the shapes of component sheet elements and the internal structure, there remains a strong tendency for such furniture when inflated to have outward bulging rounded or curved surfaces, especially at the transition areas of the bottom surface with the side, front and rear surfaces. Also, because the interior is substantially movable and compressible air, many inflatable chairs have little stability from tipping when a person sitting in them leans in any direction.

The present invention addresses the described tipping problem of inflatable chairs and inflatable sofas. The invention provides an addition or modification of the chair structure in the vicinity of the bottom or base that inhibits the tipping propensity, while retaining the basic inflatable structure concept, namely to provide a chair or sofa made essentially only from flexible plastic sheet which defines one or more interior air chambers to provide desired shape, strength and comfort.

SUMMARY OF THE INVENTION

The invention is an inflatable chair or sofa formed of thin plastic sheet and having a seat, armrests and a back formed as one or more air chambers, with additional air chambers forming stiffening or stabilizer beams situated along one or more of the front, rear and side portions of the chair on or near the bottom thereof. These additional air chambers are preferably inflatable independently of the primary air chamber(s) forming the seat, armrests and back. In a preferred embodiment there is a first stabilizer beam situated horizontally along the lower rear surface of the back of the chair and a U-shaped stabilizer beam situated beneath the front and side portions of the bottom of the seat. In use it is advised that these stabilizer beams be inflated before and firmer than the primary chair air chambers to produce stiffening and stabilizing in the left-to-right and front-to-rear directions.

A preferred embodiment of this invention will now be described with reference to the appended drawings.

DETAILED DESCRIPTION OF THE PREFERRED EMBODIMENT

Figure 11:
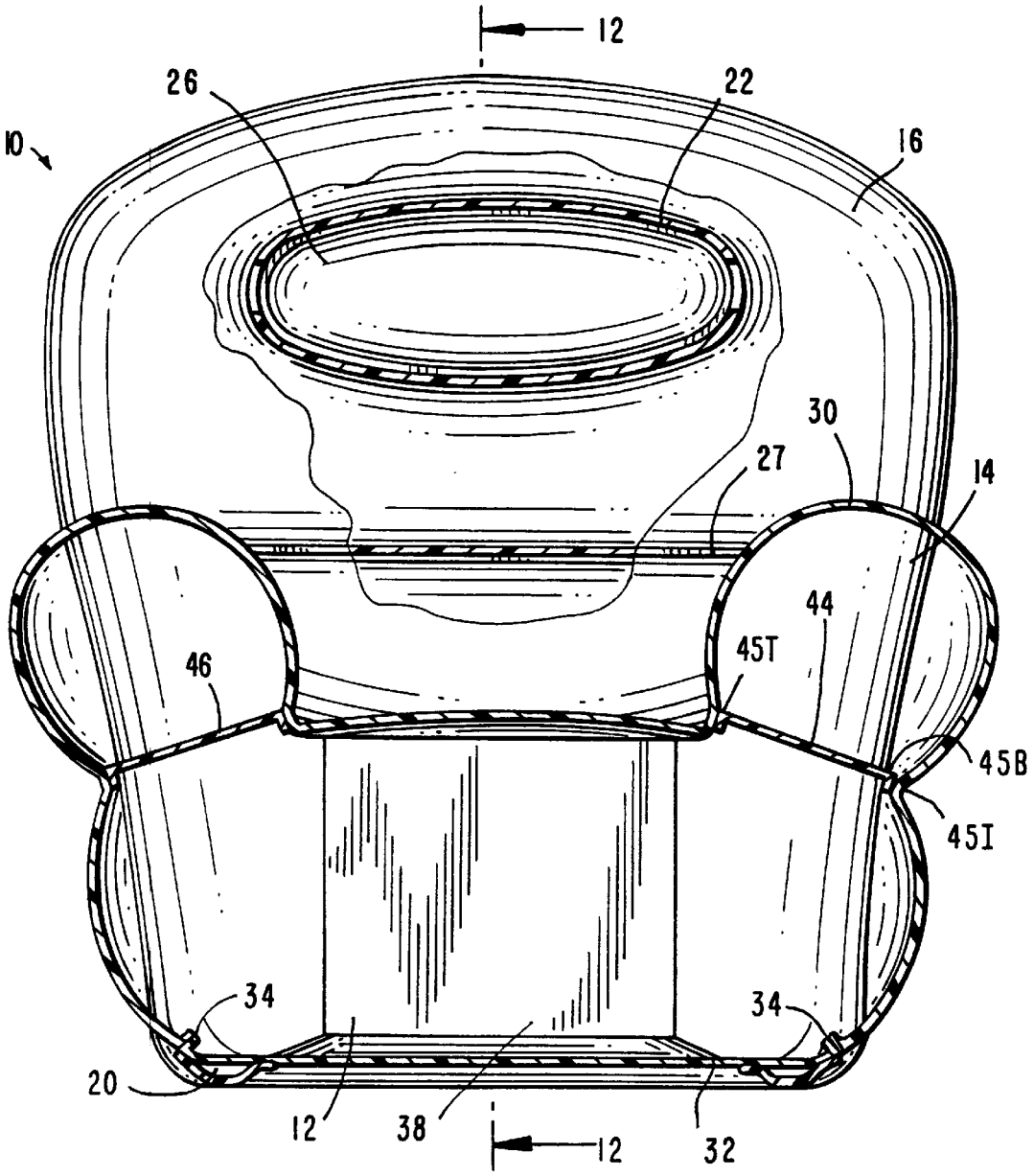
FIG. 11 is a partially cut-away front elevation view.
Figure 12:
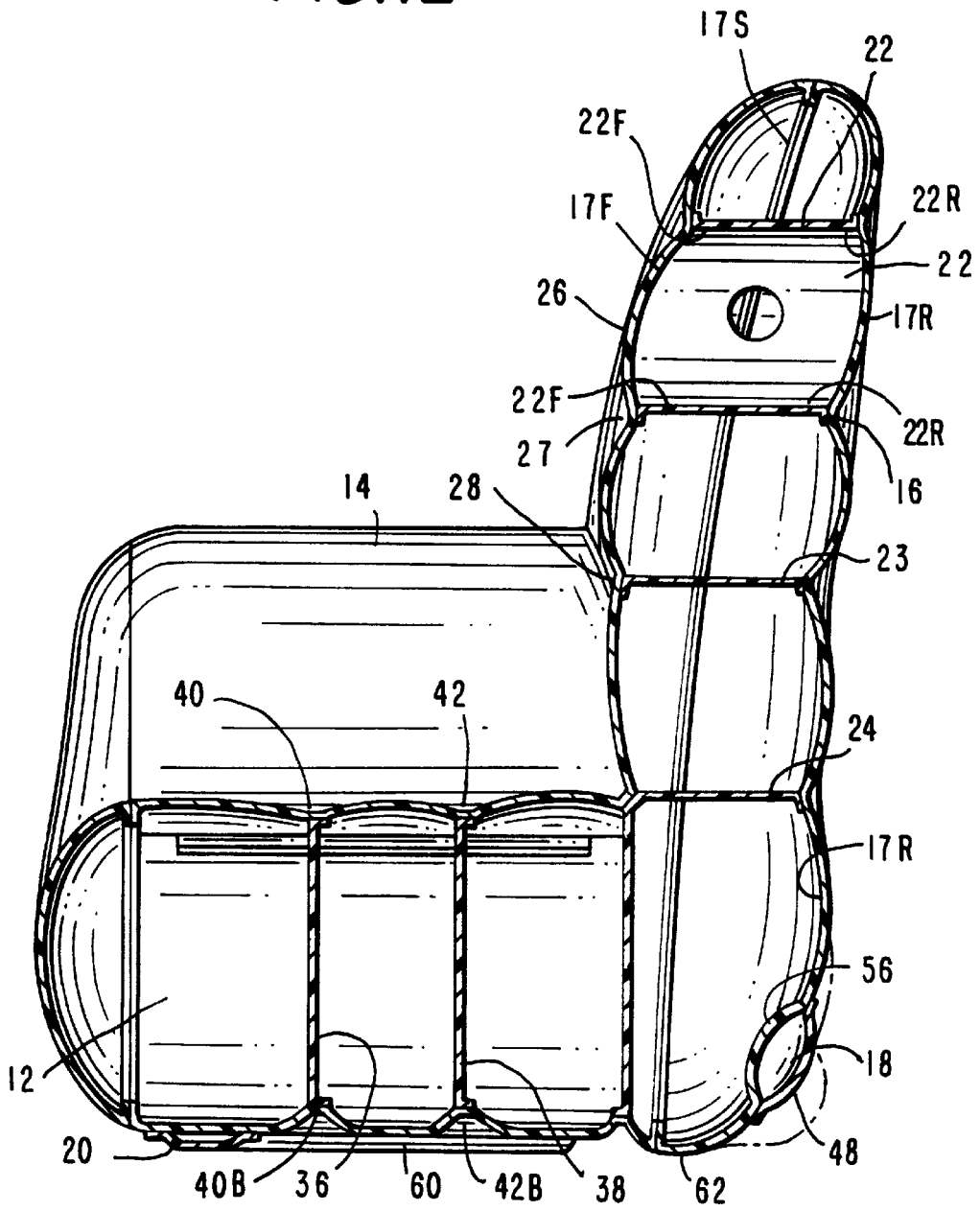
FIG. 12 is a partially cut-away right side view.

The new stabilized inflatable chair 10 as seen in FIGS. 1–6 is made of thin flexible plastic sheet. Various panels are heat-sealed along their mutual edges to form air chambers. FIGS. 11 and 12 are cut-away view of this chair showing internal structure. In the embodiment shown there is a first chamber forming the seat 12 and arms 14 a second chamber forming the back 16 a third chamber forming the rear stabilizer bar 18 and a fourth chamber forming the bottom stabilizer bar 20. Each chamber has its own inlet/outlet valve; however the first and second chambers could optionally be in fluid communication with each other and utilize a single valve. Also, the third and fourth chambers could be in fluid communication with each other and utilize another single valve. The third and fourth chambers are inflatable independently of and preferably before inflation of the first and second chambers, as will be discussed further below.

Figure 4:
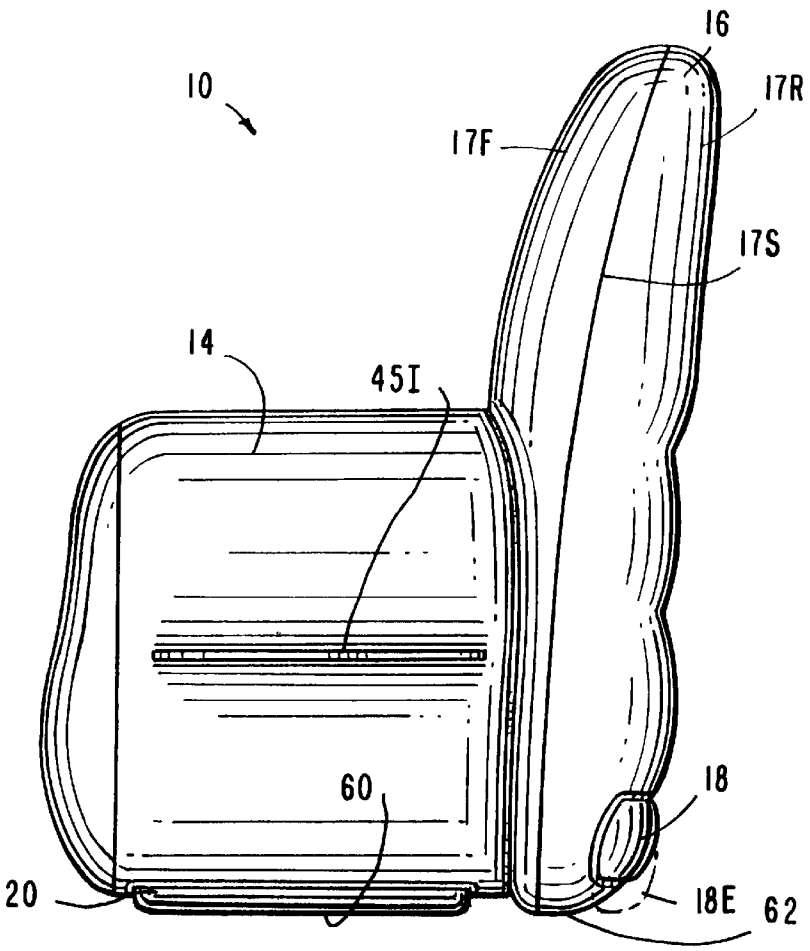
FIG. 4 is a right side view thereof.

As seen best in FIGS. 4 and 12 the second chamber for the back 16 comprises front and rear panels 17F, 17R respectively joined by a heat seal 17S along their side edges. To prevent the front and rear panels from diverging into a generally round balloon shape when inflated, these front and rear panels are joined by webs called I-beams, namely an oval I-beam 22 and straight panel I-beams 23 and 24, as seen in FIGS. 11, 12, 1, 2, 3 and 5.

Figure 2:
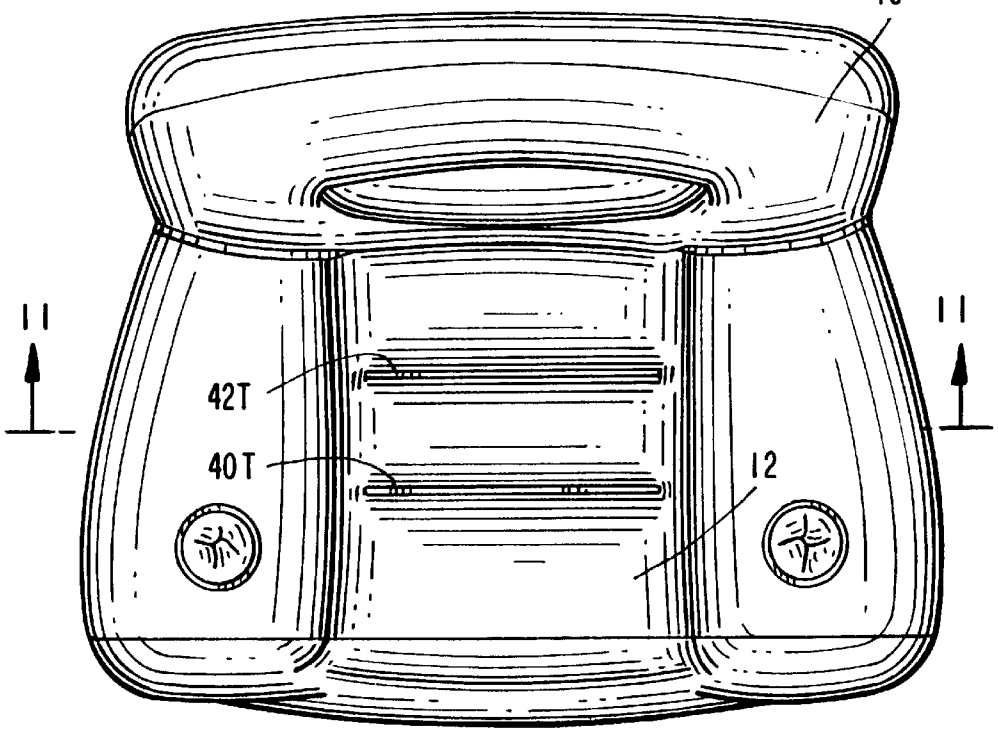
FIG. 2 is a top plan view thereof.
Figure 1:
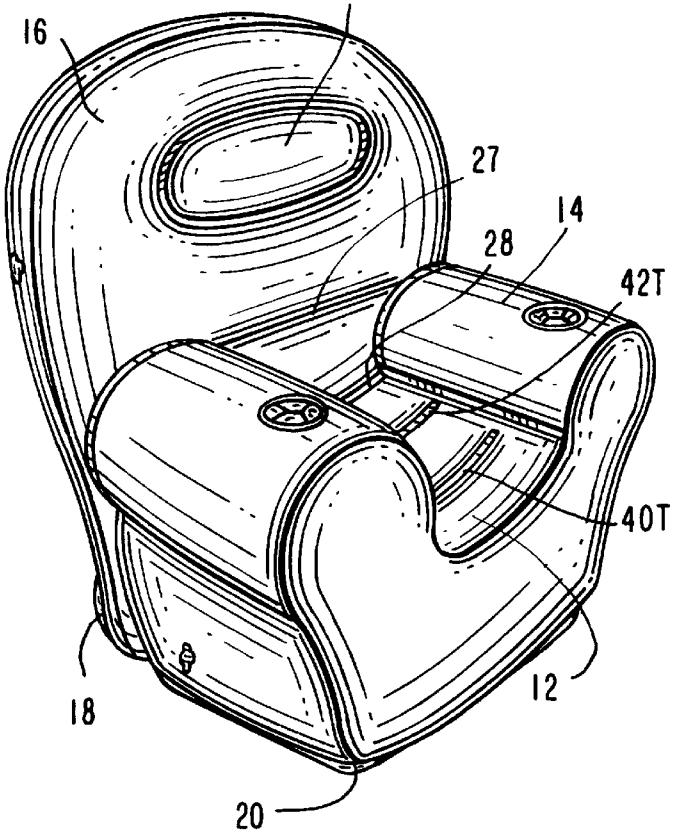
FIG. 1 is a top, front perspective view of the new inflatable chair.
Figure 3:
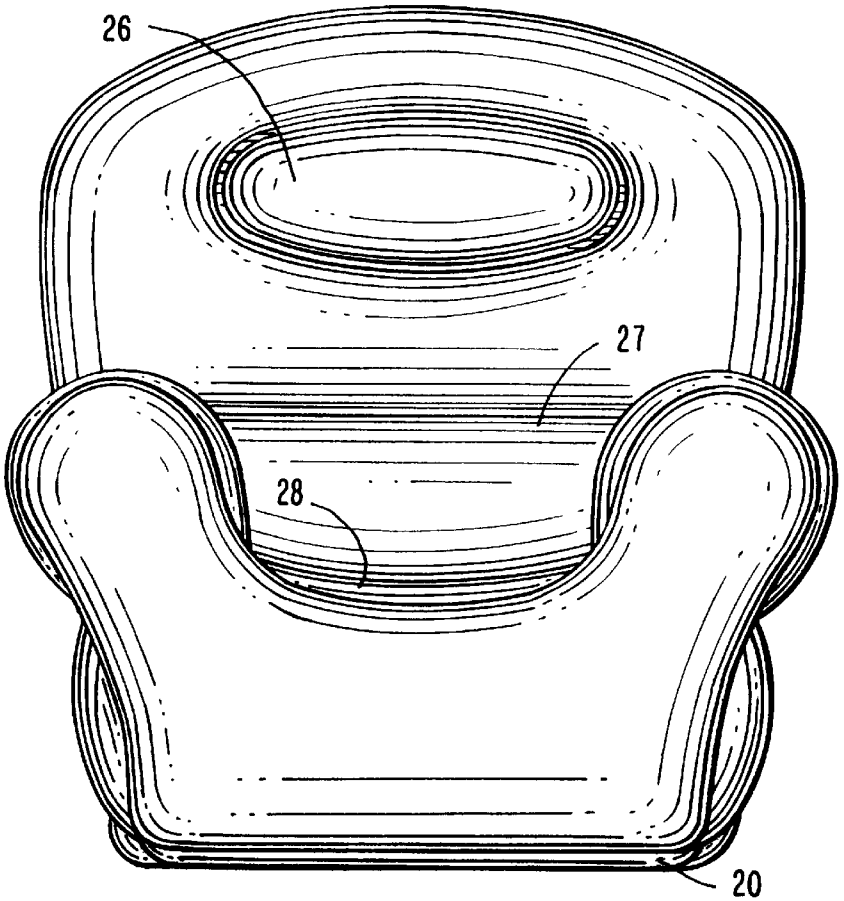
FIG. 3 is a front elevation view thereof.
Figure 5:
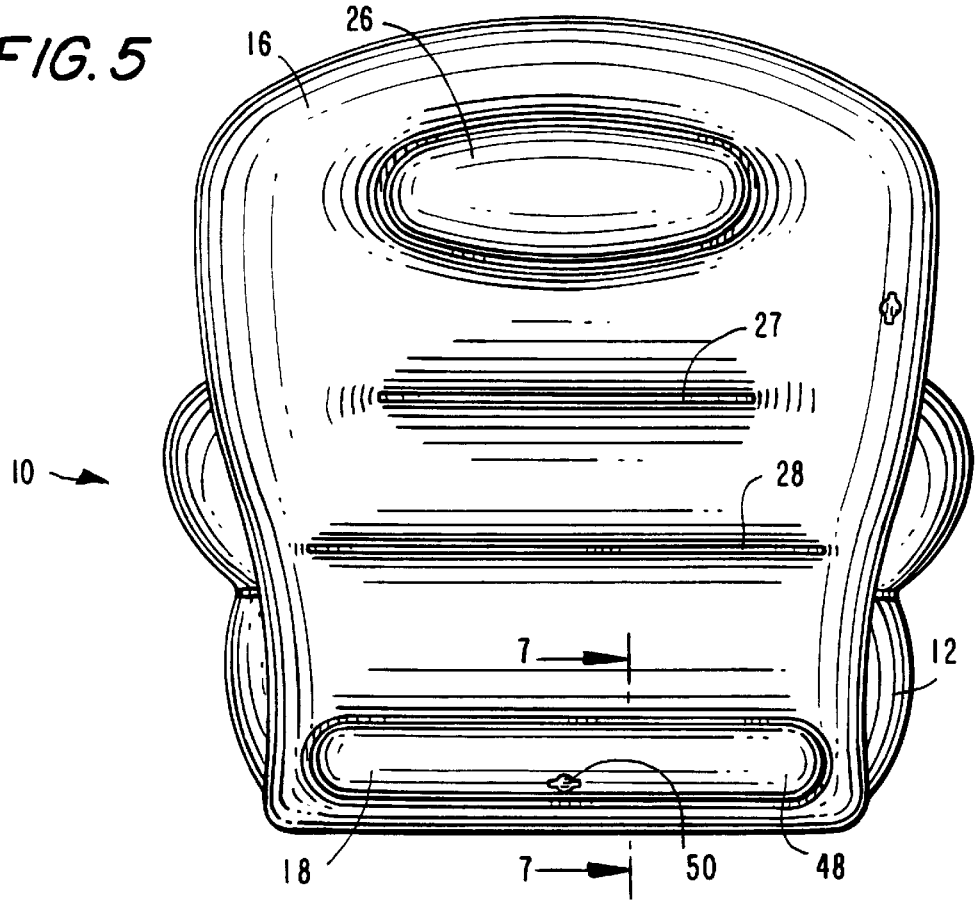
FIG. 5 is a rear elevation view thereof.
Figure 6:
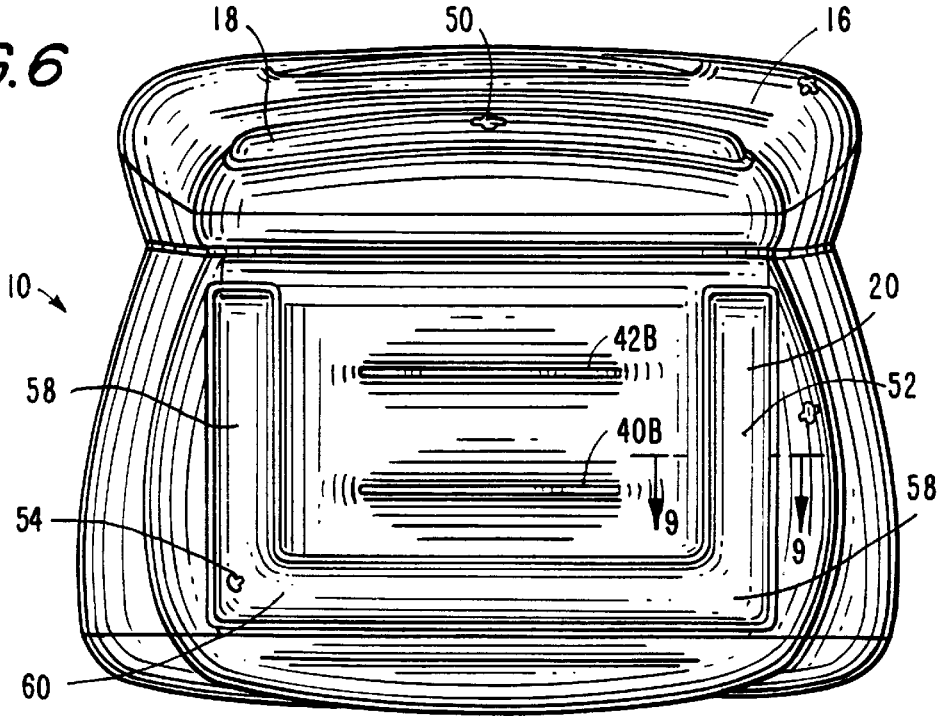
FIG. 6 is a bottom plan view thereof.

Upon inflation of this second chamber 16 the oval I-beam 22 restrains the front and back panels along the front and rear edges 22F, 22R of the I-beam, thus creating an oval shaped cushion 26 in the central area of the back 16 as seen in FIGS. 1, 3 and 5. The lower, parallel I-beams 23, 24, create indentation demarcations 27, 28 in the front and rear surfaces of the back and maintain the generally rectangular shape of the back, as seen in FIGS. 11, 12, 1, and 5. Air can pass around or through these panels in order to inflate the entire back from a single source.

The first chamber or seat 12 is formed by top and bottom panels 30, 32 best seen in FIG. 11, joined by heat seals 34 and restrained from diverging by internal webs or I-beams 36, 38 which extend vertically and in parallel across the seat 12 and create indentation/demarcation lines 40T, 40B and 42T, 42B respectively in the top and bottom of the seat as best seen in FIGS. 12 and 1. FIG. 12 shows two additional I-beams 44, 46 which maintain the shape of right and left arms. I-beam 44, for example, is a panel having opposite edges 45T, 45B heat sealed to top seat panel 30 Seal 45B creates indentations 45I upon inflation, as seen in FIGS. 11 and 4. Air can pass around the front and rear edges of these panels in order to inflate the entire seat and arms from a single source.

The third chamber 18 seen in FIGS. 1, 4, 5, 7 and 8 is the rear stabilizer beam formed by an elongated strip of plastic sheet 48 heat sealed to the rear surface of the back 16, namely to the second chamber, with a valve 50 for inflation and deflation of this third chamber.

The fourth chamber 20 seen in FIGS. 1, 3, 4, 6, 9 and 10 is the bottom stabilizer beam formed by a U-shaped strip of plastic sheet 52 heat sealed to the bottom of seat 12, namely to the first chamber, with a valve 54 for inflation and deflation of this fourth chamber.

Figure 7:
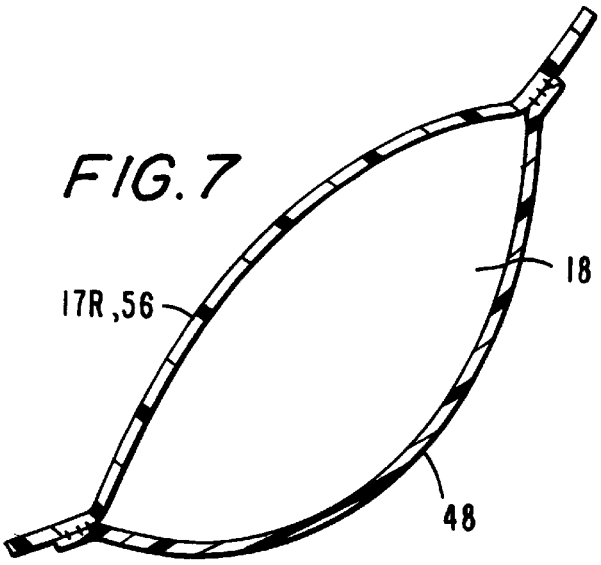
FIG. 7 is a fragmentary section taken along line 7—7 in FIG. 5.
Figure 8:
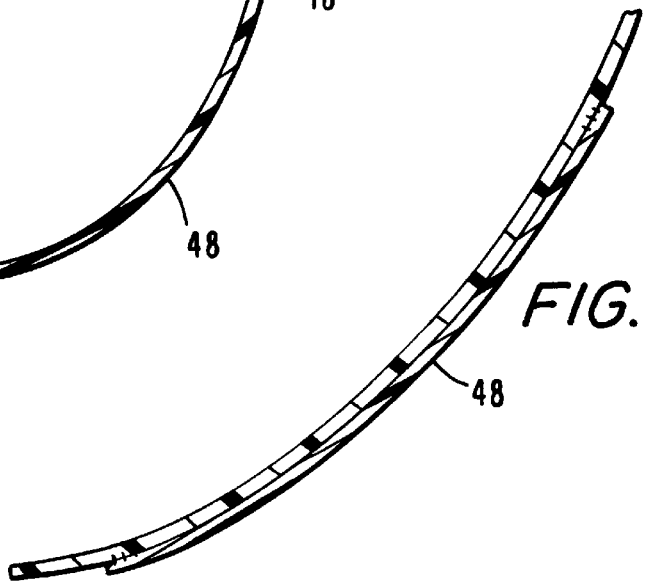
FIG. 8 is similar to FIG. 7 but in deflated condition.

For best results with this stabilized inflatable chair the third and fourth chambers are inflated before and inflated firmer than the first and second chambers. As seen in FIG. 7 area 56 is actually a portion of the rear sheet 17R of the back 16 (second chamber). When inflated firmly this third chamber forms a relatively stiff beam. Later, when the third chamber is inflated, see FIGS. 4 and 12 to a less firm state, the beam 18 formed by the third chamber stiffens the second chamber in the longitudinal direction of the beam.

Figure 9:
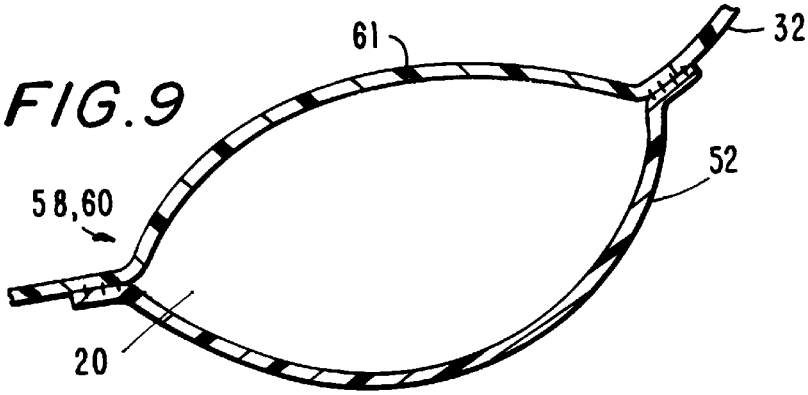
FIG. 9 is a fragmentary section taken along line 9—9 in FIG. 6.
Figure 10:
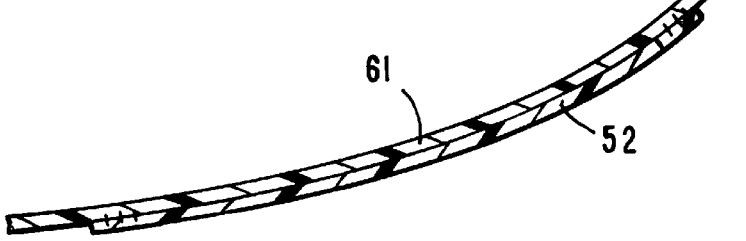
FIG. 10 is similar to FIG. 9 but in a deflated condition.

Similarly, the fourth chamber 20 when inflated as indicated in FIGS. 6, 3, 4, 11 and 12 forms stiff U-shaped beams 58 along the front-to-rear directions by the legs of the U and beam 60 along the left-to-right at the front of the chair by the base of the U. FIGS. 9 and 10 respectively indicate these beams 58, 60 in cross-section in inflated and deflated conditions. In FIGS. 9, 10 the area 61 is a portion of sheet 32 forming the bottom of seat 12, with strip 52 being heat sealed thereto.

As seen in FIGS. 4 and 12 the chair when inflated rests at the bottom 60 front on the U-shaped third chamber/beam 12 and on the bottom 62 of the second chamber 16 as seen in FIG. 4. When a person sits upon or in the chair the bottom edge 62 is compressed slightly inward until the rear beam 18 engages the floor at the bottom of FIG. 12, and as indicated by doted line 18*c* in FIG. 4. With the chair now resting upon its stabilized beams 18, 20, due to the downward force of a person sitting therein, the stiffness of the beams helps stabilize the chair from tipping sideways or frontward or rearward. This does not totally prevent such tipping, but these beams add considerable rigidity to the chair and add resistance to deformation and tipping when a person sits and/or shifts his/her weight, as was a problem with prior art chairs of the same general type.

The sheet material used for this article could be selected from a variety of soft, thin, flexible thermoplastic sheet materials that are substantially air impermeable and preferably thermoplastic, such as polyvinylchlorides, polyolefins and polyesters having thickness in the range of about 0.20 mm to 0.40 mm. These panels would be sealed together by the typical heat or ultrasonic sealing or other common techniques. The valves used are typical of those used in the inflatable products industry.

This invention may take a variety of other forms still within the scope of the invention and the claims appended hereto. These forms include inflatable chairs and sofas of many outer shapes and many internal structures defining selected air chambers.

What is claimed is:

1. An inflatable chair comprising a seat part including a top and a bottom, said bottom having front, rear and sides, a pair of armrests extending upward from said top, and a back part at the rear of said seat part, said seat part, back part and armrests defining inflatable first chambers, first valve means for inflating said first air chambers, said inflatable chair further comprising inflatable second air chambers having generally tubular form at said front and sides of said bottom of said seat part and situated only beneath said bottom of said seat part, and second valve means for inflating said second air chambers, said second air chambers being inflatable independently of said first air chambers for providing a stabilizing support to resist tipping of said chair.

2. An inflatable chair according to claim 1 wherein each of said second air chambers defines a generally straight tube having length substantially greater than its diameter.

3. An inflatable chair according to claim 1 wherein said second air chambers are in fluid communication with each other thus defining a single air chamber.

4. An inflatable chair according to claim 1 wherein said second air chambers when inflated are substantially firmer than said first chambers.

5. An inflatable chair according to claim 1 wherein each of said second air chambers has diameter in the range of two inches to five inches.

6. An inflatable chair according to claim 1 wherein said second air chambers define a U-shape situated at said front and side parts respectively and a separate rear part.

7. A chair according to claim 6 wherein said second air chambers situated at said front, rear and side parts define a rectangle and comprise a single air chamber.

8. A chair according to claim 6 wherein each of said second air chambers extends substantially the full dimension of the front, rear and side parts respectively.

9. A method of inflating a chair according to claim 1 wherein said second air chambers are inflated firmly before said first air chambers are inflated.

10. A method according to claim 9 wherein said second air chambers are inflated to a higher pressure than said first air chambers.

11. An inflatable chair according to claim 1 wherein said back part has opposite sides and a bottom portion extending the distance between said sides, and said second air chambers further comprise a tubular air chamber at said bottom portion and extending the distance between said sides.

12. An inflatable chair formed of thin flexible plastic sheet, the chair comprising a seat part having a bottom surface and arms on the sides of the seat part, and a back which has a rear surface having top and bottom portions thereof, valve means for inflating said seat and back parts, a first stabilizer beam comprising an elongated inflatable air chamber extending generally horizontally along only said rear surface of said back at the bottom portion thereof, and valve means for inflating said first stabilizer beam independently of said seat and back parts, wherein said first stabilizer beam comprises a strip of thin flexible plastic sheet having peripheral edges heat sealed to a first portion of said plastic sheet of said back to define said elongated air chamber between said strip and said portion of said sheet, said first portion of said sheet projecting inwardly into said back when said elongated air chamber is inflated before inflation of said back, said first portion of said sheet continuing to project inwardly after inflation of said back.

13. An inflatable chair according to claim 12 wherein said second stabilizer beam means comprises a second strip of thin flexible plastic sheet having peripheral edges heat sealed to a second portion of said plastic sheet of said seat to define said second elongated air chamber between said second strip of said second portion of said sheet, said second portion of said sheet projecting inwardly into said seat when said second elongated air chamber is inflated before inflation of said seat, said second portion of said sheet continuing to project inwardly after inflation of said seat.

* * * * *